US006609844B1

(12) United States Patent
Petteruti et al.

(10) Patent No.: US 6,609,844 B1
(45) Date of Patent: Aug. 26, 2003

(54) PORTABLE PRINTER HAVING AUTOMATIC PRINT ALIGNMENT

(75) Inventors: Steven F. Petteruti, East Greenwich, RI (US); Majid Amani, East Greenwich, RI (US); Gregory J. Klein, Newport, RI (US); Richard J. Preliasco, North Kingstown, RI (US); Anna H. Doyle, West Greenwich, RI (US); Robert A. Petteruti, E. Greenwich, RI (US)

(73) Assignee: ZIH Corp., Wilmington, DE (US)

( * ) Notice: Subject to any disclaimer, the term of this patent is extended or adjusted under 35 U.S.C. 154(b) by 0 days.

(21) Appl. No.: 10/035,496

(22) Filed: Nov. 9, 2001

(51) Int. Cl.[7] ..... B41J 3/36

(52) U.S. Cl. ..... 400/88; 400/613; 400/619; 400/692; 400/693; 101/407.1

(58) Field of Search ..... 400/88, 691–693, 400/611–621.2; 101/407.1; 242/570, 577, 590, 596–596.8

(56) References Cited

U.S. PATENT DOCUMENTS

| | | | | | |
|---|---|---|---|---|---|
| 5,267,800 | A | | 12/1993 | Peteruti et al. | 400/88 |
| 5,398,049 | A | | 3/1995 | Terasawa et al. | 347/8 |
| 5,447,379 | A | | 9/1995 | Pou | 400/88 |
| 5,806,993 | A | | 9/1998 | Petteruti et al. | 400/88 |
| 5,813,343 | A | * | 9/1998 | Harb | 101/407.1 |
| 5,860,753 | A | | 1/1999 | Beck et al. | 400/692 |
| 5,918,989 | A | * | 7/1999 | Stout et al. | 400/88 |
| 6,004,053 | A | | 12/1999 | Petteruti et al. | 400/693 |
| 6,007,184 | A | | 12/1999 | Terasawa et al. | 347/50 |
| 6,015,202 | A | | 1/2000 | Hiramatsu et al. | 347/32 |
| 6,158,342 | A | * | 12/2000 | Moore | 101/407.1 |
| 6,193,344 | B1 | | 2/2001 | Otsuka et al. | 347/11 |
| 6,261,013 | B1 | * | 7/2001 | Bryer et al. | 400/613 |
| 6,302,604 | B1 | * | 10/2001 | Bryant et al. | 400/619 |
| 6,431,492 | B1 | * | 8/2002 | Chillscyzn | 242/577 |

OTHER PUBLICATIONS

Zebra Technologies, Inc., Printout of Bar Code Printers from Web Site Pages at http://www.zebra.com, Feb. 2002.

* cited by examiner

*Primary Examiner*—Andrew H. Hirshfeld
*Assistant Examiner*—Minh H. Chau
(74) *Attorney, Agent, or Firm*—Kenneth J. Lukacher

(57) ABSTRACT

A portable printer for printing on a roll of paper or label stock is provided having automatic print alignment with the width of the roll. The portable printer has a housing having a compartment for receiving the roll, a cover to access the roll, and a centering mechanism for the roll. The centering mechanism has two rotatable spindle members in the compartment engageable with the opposing ends of the roll's tubular core, and a pair of racks each coupled to one of the spindle members, and to each other by a gear, to enable each of the spindle members to move in opposite directions with respect to a center between the spindle members. The position of centering mechanism is optically, magnetically, or electro-mechanically encoded and a sensor reads the encoded position of the centering mechanism. A controller automatically aligns printing with respect to the roll's width in accordance with the encoded position read by the sensor, thereby preventing printing outside the width of the paper from the roll. The centering mechanism may be locked when the cover is closed to prevent movement of the gear, and the spindle members and racks coupled thereto. A removable RF communication module may be provided in the printer to enable communication with a host terminal or computer system.

26 Claims, 13 Drawing Sheets

PORTABLE PRINTER HAVING AUTOMATIC PRINT ALIGNMENT

DESCRIPTION

The present invention relates to a portable printer having automatic print alignment, and particularly to a portable printer having automatic print alignment in accordance with the width of a roll of paper or label stock centered in the printer. The portable printer provides for locking the centered position of the roll when a cover for accessing the roll in the printer is closed and unlocking the position of the roll when the cover is opened.

BACKGROUND

Conventional portable printers use a roll of wound stock material, such as paper or label stock, which is loaded into the printer such that the paper from the roll will properly feed and align with a thermal print head for printing. These rolls may be in different widths such that labels or different widths may be printed.

A roll may be side-loaded and centered onto a spindle as shown in U.S. Pat. No. 5,860,753, or top-loaded and centered, as in the label printer manufactured by Zebra Technologies, Corp., Camarillo, Calif., model no. P2242. Printers providing for a top-loaded roll have a cavity to receive the roll and two rotatable spindle members are urged by spring or springs into the tubular core of the rolls into a centered position with respect to the print head of the printer. One problem with top-loaded portable printer is that when the printer is dropped or otherwise receives an accidental impact, the roll can disengage from the spindle members, negatively impacting printer function or require the operator to reset the roll between the spindle members.

Regardless of the loading approach used, the print head of a typical portable printer is of a length sufficient to print the widest paper for that printer so as to accommodate the range of roll widths. When rolls are of a width less than the print head length, the print head's width exceeds the paper width. Typically, the user of the portable printer must assure that the roll is of a proper width for the information to be printed, otherwise the printing may extend beyond one or both sides of the paper from the roll, or from one side of the roll from a non-centered roll. Examples of portable printers with non-centered rolls are shown for example in U.S. Pat. Nos. 5,267,800 and 5,447,379. Thus, printing elements of the print head may be utilized corresponding to areas outside the width of the roll, which over time will likely damage the print head. This damage is due to heat buildup by printing elements that are not in contact with the paper, and therefore, not able to transfer heat to the paper. Thus, it is desirable to automatically align printing by a portable printer with the width of the roll.

In larger ink jet printers a reflective sensor may be provided under the carriage for detecting the width of sheets of paper transported from a stack of paper. Such ink jet printers, are described, for example, in U.S. Pat. Nos. 5,398,049, and 6,007,184. A paper width detector LED and paper width sensor are described in the ink jet printer of U.S. Pat. No. 6,193,344. However, such ink jet printers due to their weight or size cannot be practically worn or hand carried and are not part of any centering mechanism for a roll.

SUMMARY OF THE INVENTION

It is an object of the present invention to provide a portable printer for printing on a roll of paper or label stock having automatic print alignment with the width of the roll, thereby preventing printing outside the width of the paper from the roll.

It is another object of the present invention to provide a portable printer having a centering mechanism for a roll in which the centering mechanism can be locked to prevent accidental disengagement of the roll from the centering mechanism when a cover for accessing the roll is closed.

A further object of the present invention is to provide a portable printer having a removable wireless (RF) communication module.

Briefly described, the portable printer embodying the present invention has a housing having a compartment for receiving the roll, a cover to access the roll, and a centering mechanism for the roll. The centering mechanism has two rotatable spindle members in the compartment engageable with the opposing ends of the roll's tubular core, and a pair of racks which are each coupled to one of the spindle members by an edge guide arm, and to each other by a gear, to enable the spindle members to move in opposite directions with respect to a center between the spindle members. The position of centering mechanism with respect to the roll's width is optically encoded by indicia on one of the racks with respect to a fixed sensor capable of illuminating and reading a portion of the indicia representative of the encoded position of the rack having the indicia and of the roll width. A controller in the housing automatically aligns printing with respect to the roll's width in accordance with the encoded position read by the sensor.

In an alternative embodiment to the optical indicia and sensor, the position of centering mechanism with respect to the roll's width is magnetically encoded by a magnet on one of the racks or edge guide arm with respect to a magnetic sensor in the housing capable of detecting the level of the magnetic field (and/or polarity) of the magnet which changes in accordance with distance (and/or position) of the magnet with respect to the sensor, thereby enabling the sensor to provide a signal representative of the encoded position of the centering mechanism with respect to the roll's width. In another alternative embodiment, an electromechanical position encoder is used with the wheel which mechanically encodes the position of the centering mechanism with respect to the rotationally movement of one of the racks or the gear, and outputs a value to the controller representatively of the position of the centering mechanism with respect to the roll's width. In a further alternative embodiment, a resistive strip replaces the indicia and a voltage is applied to the strip, such that a fixed sensor provided by a electrical wire or wiper reads the voltage signal from the strip. As wiper reads different locations along the strip, different voltage signals are provided and these signals are representative of the encoded position of the centering mechanism with respect to the roll's width.

A locking mechanism may be coupled to the centering mechanism to lock the centering mechanism when the cover is closed to prevent movement of the gear and the spindle members and racks coupled thereto. The locking mechanism includes a pivotable lock actuator which pivots as the cover is opened and closed, and a gear lock member coupled to the lock actuator, in which the gear lock member engages the gear of the centering mechanism to lock the rotation of the gear when the lock actuator pivots in a first direction in response to the cover being closed, and disengages the gear when the lock actuator pivots in an opposite direction when the cover is opened. The lock actuator pivots in response to a pivotable latch member which rotates the lock actuator to lock the cover when closed, which and when released, allows an operator to open the cover to access the roll compartment.

The portable printer may further have a removable RF communication module accessible through an opening in the printer's housing for connection with the controller to enable communication with a host terminal or computer system.

BRIEF DESCRIPTION OF THE DRAWINGS

The foregoing objects, features and advantages of the invention will become more apparent from a reading of the following description in connection with the accompanying drawings, in which.

DETAILED DESCRIPTION OF THE INVENTION

Figure 1:
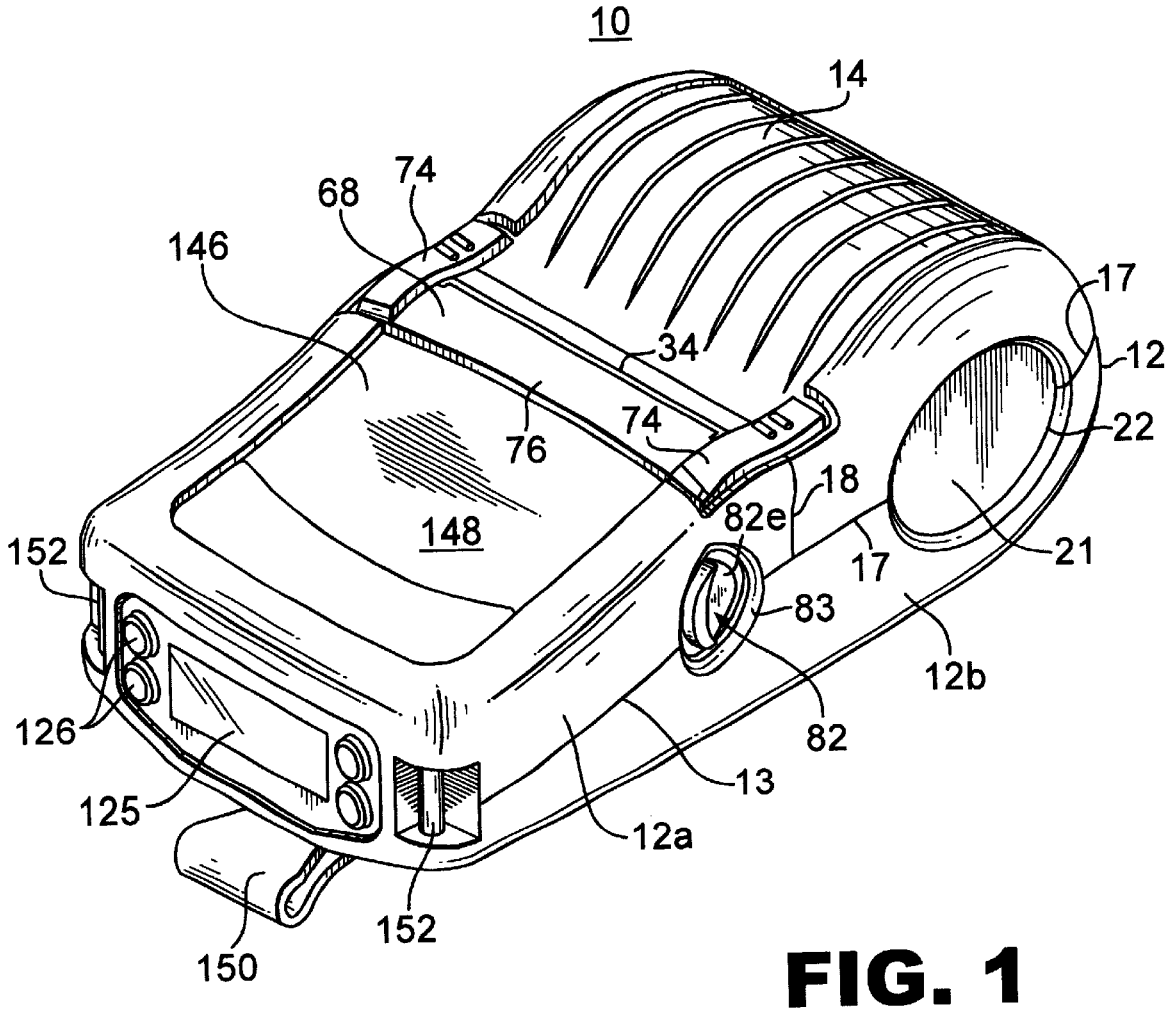
FIG. 1 is a perspective view of the portable printer in accordance with the present invention showing the cover to the roll compartment closed.
Figure 2:
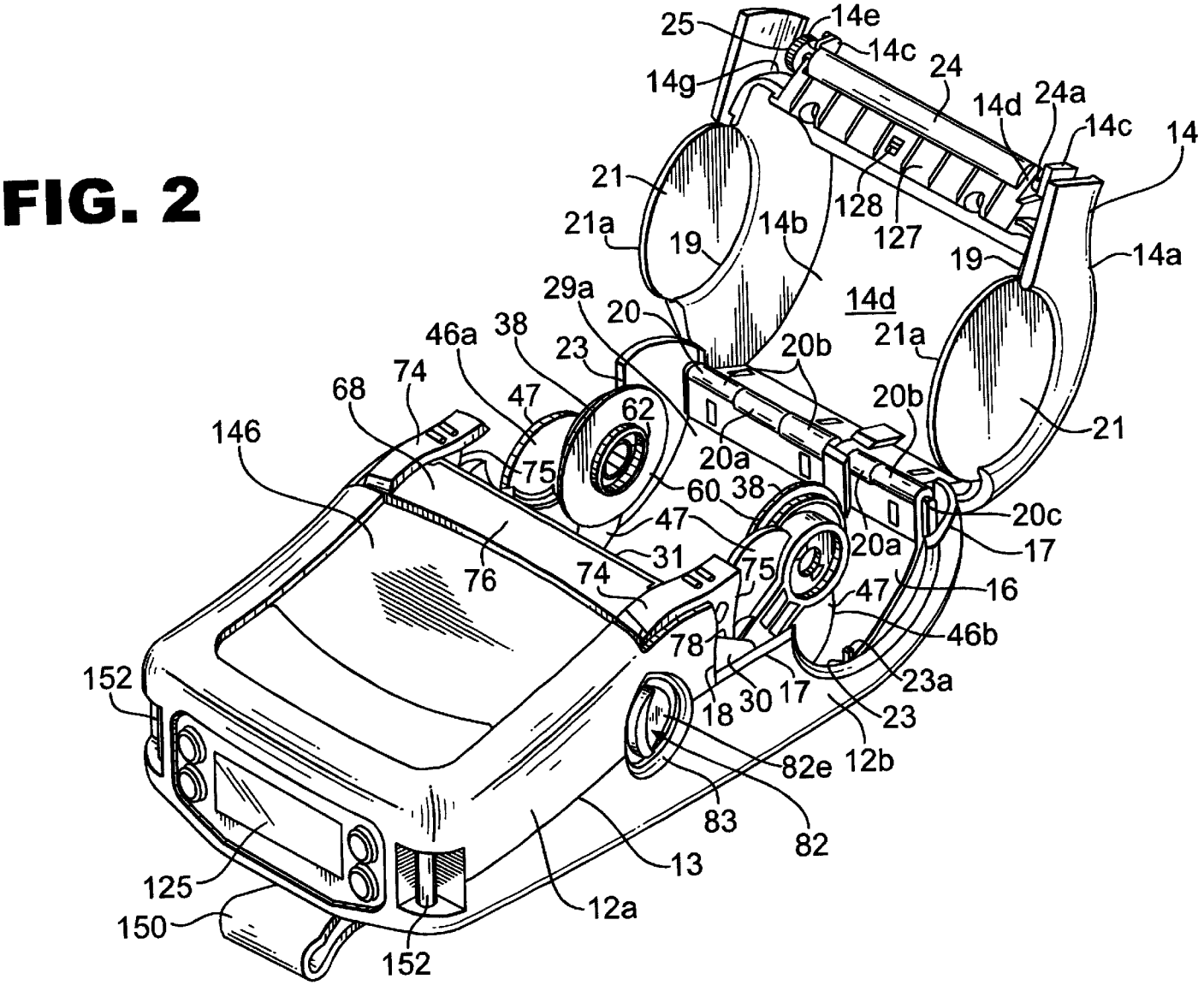
FIG. 2 is a perspective view of the portable printer of FIG. 1 showing the cover to the roll compartment open.
Figure 2A:
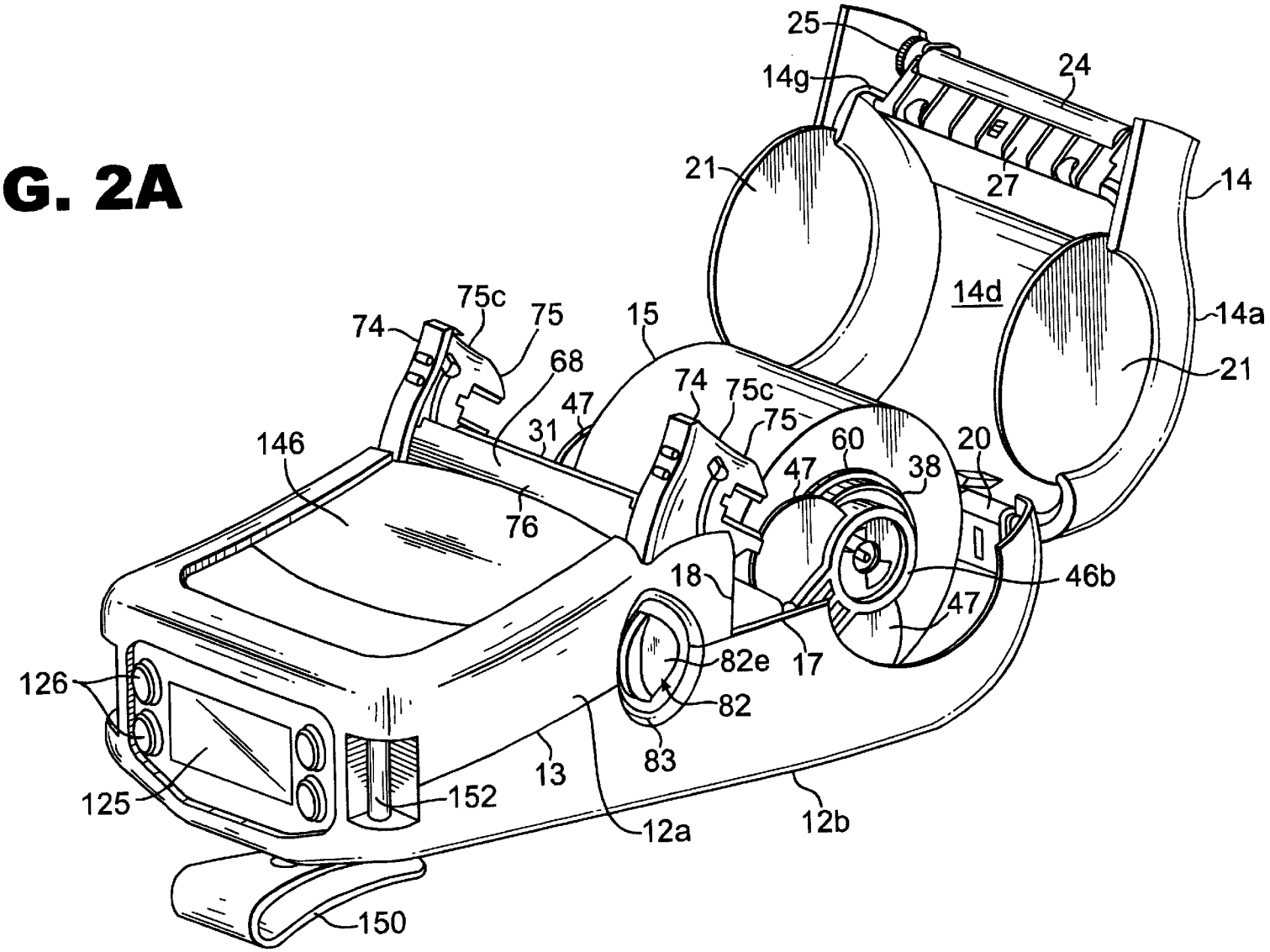
FIG. 2A is the same view of FIG. 2 showing a roll centered in the compartment with the cover open and the latch member in its up position.

Referring to FIGS. 1, 2, and 2A, a portable printer 10 is shown having a housing 12 with an upper housing section 12*a,* a lower housing section 12*b* which mates with the upper housing section 12*a* along edge 13, and a cover 14 for a compartment 16 in the printer which receives a roll of paper or label stock. The cover 14 when closed mates along edge 17 with the lower housing section 12*b* and edge 18 of the upper housing section 12*a.* The roll 15 may be made of thermally sensitive paper or label stock representing paper having thermally sensitive labels thereon. Roll 15 is shown in FIG. 2A as illustrative of an example of a roll, since rolls maybe provided of different widths. The cover 14 is coupled to the lower housing section by a hinge 20 to enable the cover to pivot to an open position, such as shown in FIG. 2, or to a closed position as shown in FIG. 1. The housing 12 further has two windows 21 which are located in openings 22 on either side of compartment 16 when cover 14 is closed. The upper edge of each window 21 is fixed (such as by friction and/or adhesive) in a groove 19 formed between an outer portion 14*a* and an inner portion 14*b* forming cover 14, such that when the cover is closed, the lower edge 21*a* of each of window is received along inner wall 23 of lower housing section 12*a.* A notch 23*a* may be provided extending from the interior wall 23 for each side of the lower housing section 12*b* to receive the window 21 along edge 21*a.* The housing 12 may be made of molded plastic, and windows 16 made of clear plastic of an oval or circular shape.

The cover 14 has a platen roller 24 having a shaft 24*a* mounted for rotation between two flanges 14*c* extending from the inner portion 14*b* of the cover. One end of the shaft 24*a* extend through a hole 14*d* in one of the flanges 14*c,* while the other end of the shaft has a gear 25 and is captured in a slot 14*e* in the other of the flanges 14*c.* When cover 14 is closed, the gear 25 is part of a gear train coupled to a motor 26 (FIG. 6A) to drive the platen roller 24 and pull paper from the roll in compartment 16 and along interior ridged surface 27 of cover 14. An optional peel bar (not shown) may be provided adjacent the platen roller 24 between a further extension of flanges 14*c* to enable peeling of labels from a roll of label stock. The motor 26, and gear train coupling the motor's rotation to the platen roller 24 via gear 25, are described in U.S. Pat. No. 6,004,053, which is herein incorporated by reference.

Figure 6B:
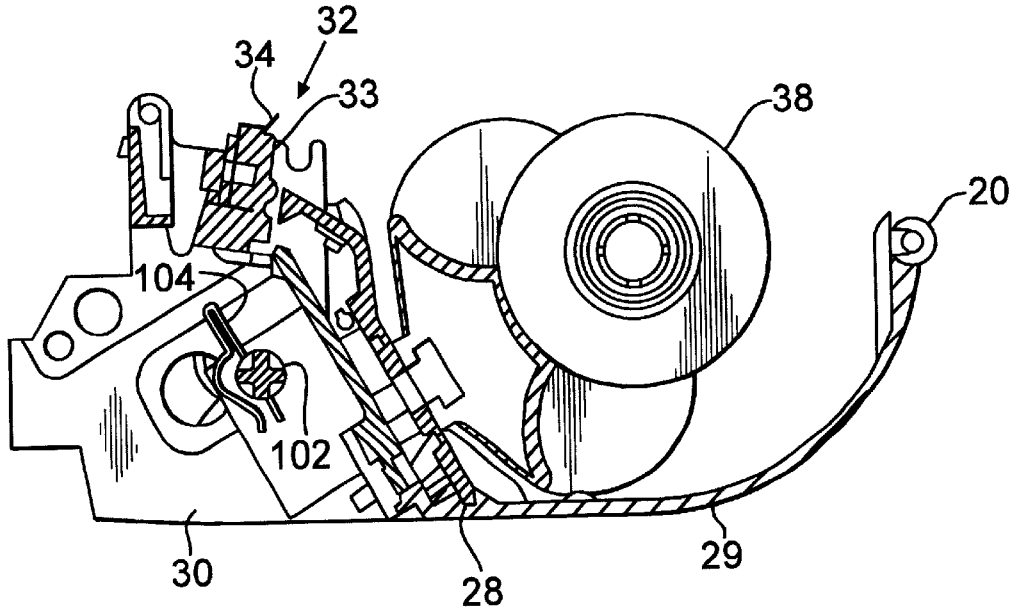
FIG. 6B is a cross-sectional view of the printer of FIG. 6 along lines 6B—6B.

The compartment 16 is defined by the interior surface 14*d* of inner portion 14*b* of the cover 14, windows 21, the surface 29*a* of a plate 29 located in the lower housing section 12*b,* and a front surface 28*a* of a plate 28. The curved plate 29 is an extension of a frame 30 located behind plate 28. Plate 29 extends from below plate 28 and curves along the bottom of compartment 16 to hinge 20. The hinge 20 may be provided by fingers 20*a* and 20*b* which extend from cover 14 and plate 29, respectively, and through which extends a shaft 20*c* journal at its ends in lower housing section 12*b.* Plate 29 and frame 30 represents a single molded component, but may also be separate components joined together. Plate 28 forms an integrated assembly with a frame 30 which is attached to the lower housing section 12*b,* as described later below. A printing mechanism 32 having a print head 33 (FIG. 6B) with a line of printing elements forms a printing assembly mounted on frame 30, such that print head 33 is disposed opposite the platen roller 24 when the cover 14 is closed to enable paper from the roll to be pulled by the platen roller across the print head prior to the paper exiting the printer. Frame 30 has a plate 31 which extends upwards to provide a support for the print head 33, and left and right walls 31*a* and 31*b,* respectively. Frame 30 may further support a tear bar 34 above the print head 33. The printing mechanism 32 and its assembly, and mounting to the frame with the tear bar, may be as described in incorporated U.S. Pat. No. 6,004,053.

Figure 3:
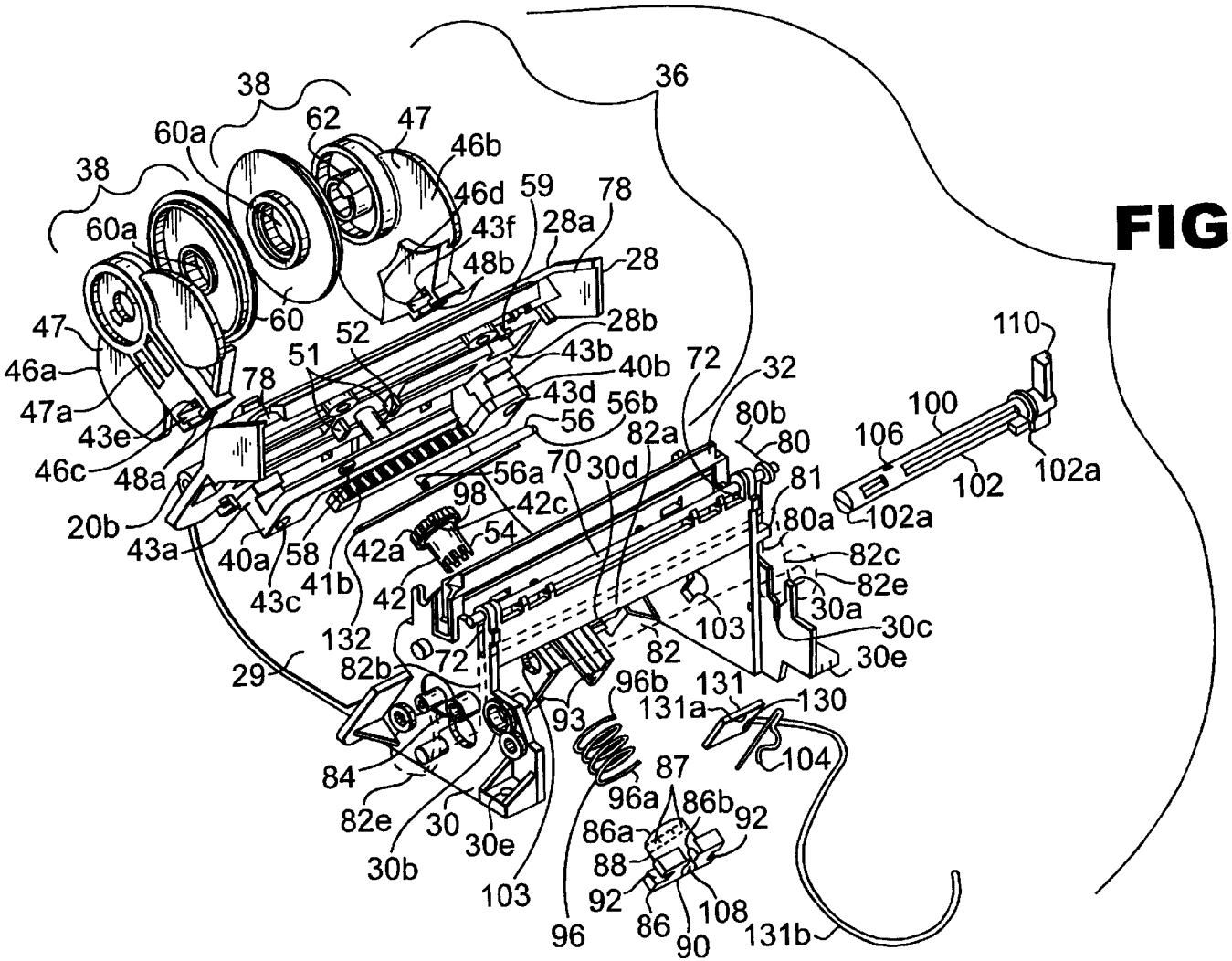
FIG. 3 is an exploded perspective view of the portable printer of FIG. 1 without the printer housing showing the assembly of the centering mechanism and its locking mechanism with respect to the frame of the printer.
Figure 4:
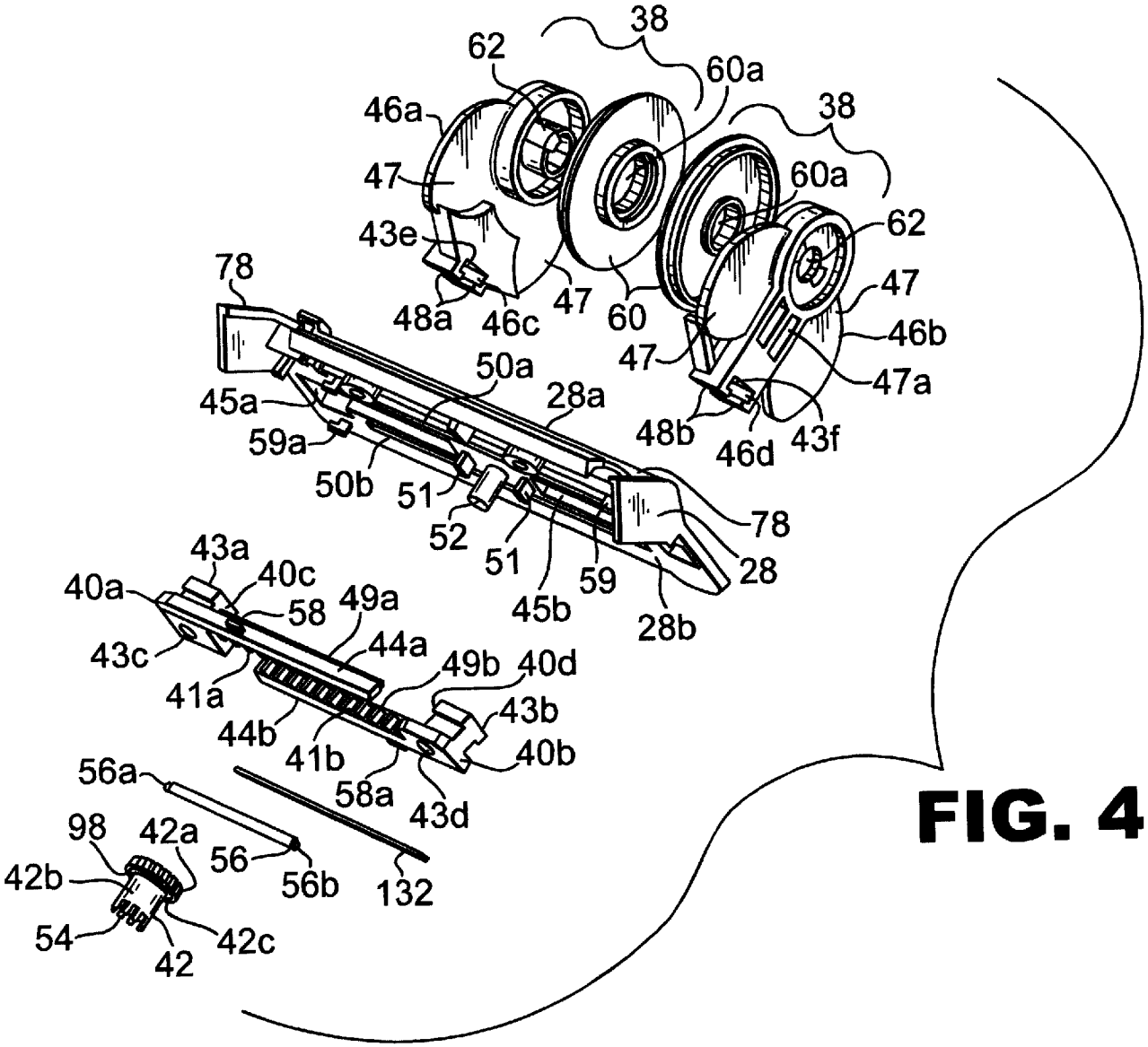
FIG. 4 is an exploded view of the centering mechanism in the portable printer of FIG. 1.

Referring to FIGS. 3 and 4, a centering mechanism 36 is provided in housing 12 to enable the paper from the roll 15 to be centered with respect to the print head 33. The centering mechanism 36 has two rotational spindle members 38 in compartment 16, which engage the opposing ends of a roll's tubular core, and a rack and pinion assembly coupled to the spindle members located between the back surface 28*b* of the plate 28 and the frame 30. The rack and pinion assembly enables movement of the spindle members 38 in opposite directions with respect to a center position between them, thus centering the paper from the roll about its width with the center of print head 33 with respect to the print head's length. The rack and pinion assembly includes two racks 40*a* and 40*b* each with teeth 41*a* and 41*b*, respectively, engaging the teeth 42*a* of a common pinion or gear 42. Each of the racks 40*a* and 40*b* has a T-shaped section 43*a* and 43*b*, respectively, and an elongated section 44*a* and 44*b* along which one side are teeth 41*a* and 41*b*, respectively. T-shaped sections 43*a* and 43*b* of their respective racks extend through slots 45*a* and 45*b*, respectively, in the plate 28 and captured in a notch 46*c* and 46*d* of an edge guide arms 46*a* and 46*b*, respectively, shaped to each the respective T-shaped section. The edge guide arms 46*a* and 46*b* are each attached to their respective racks 40*a* and 40*b* by a screw through rack hole 43*c* and 43*d*, respectively, in respective threaded hole 43*e* and 43*f* in the edge guide arms. Slots 45*a* and 45*b* are each larger at one end to facilitate installation and assembly of the large part of the T-shaped section of the racks into the edge guide arms. Each edge guide arms 46*a* and 46*b* is coupled to one of the spindle members 38 and has lobe extensions 47 from a support member 47*a* to guide the roll. Edge guide arms 46*a* and 46*b* slide upon surfaces 48*a* and 48*b*, respectively, along front surface 28*a* of plate 28 as their respective racks 40*a* and 40*b*, move in respective slots 45*a* and 45*b*. Each rack 40*a* and 40*b* has a ridge 49*a* and 49*b* along the length of their respective sections 44*a* and 44*b* which travels in a groove or track 50*a* and 50*b*, respectively, along the back surface 28*b* of plate 28. The gear 42 is mounted for rotation on a shaft 52 extending from the back surface 28*b* of plate 28. The rotation of the gear 42 is coupled to circle of teeth 54 provided on the end of a hollow cylinder 42*b* of the gear which extends from the gear's surface 42*c* in a direction opposite the plate 28.

An extension spring 56 has one end 56*a* attached to rack 40*a* at a hook or pin 58 and the other end to a hook or pin 59 extending from the back surface 28*b* of plate 28. The spring 56 applies force on rack 40*a*, and rack 40*b* via gear 42, such that their coupled spindle members 38 are biased towards the center position between them, thus urging the spindle members to the roll when between the spindle members. Optionally, another extension spring may be provided between a hook or pin 58*a* of rack 40*b* and a hook or pin 59*a* from the back surface of plate 28. For each rack 40*a* and 40*b*, a stop 51 is provided from the back surface 28*b* of the plate which limits the forward movement of the rack moving the spindle members towards each other by abutment of stop 51 against rack surface's 40*c* and 40*d*, respectively. Spindle members 38 coupled to each of edge guide arms 46*a* and 46*b* may represent a disk 60 mounted for rotational movement on a hub 62 which extends from the edge guide arm. With the rack and pinion assembly between plate 28 and frame 30, the plate 28 is attached to the frame 30 by screws (not shown) through frame holes 66 into threaded holes 64 extend from the plate 28.

Figure 3A:
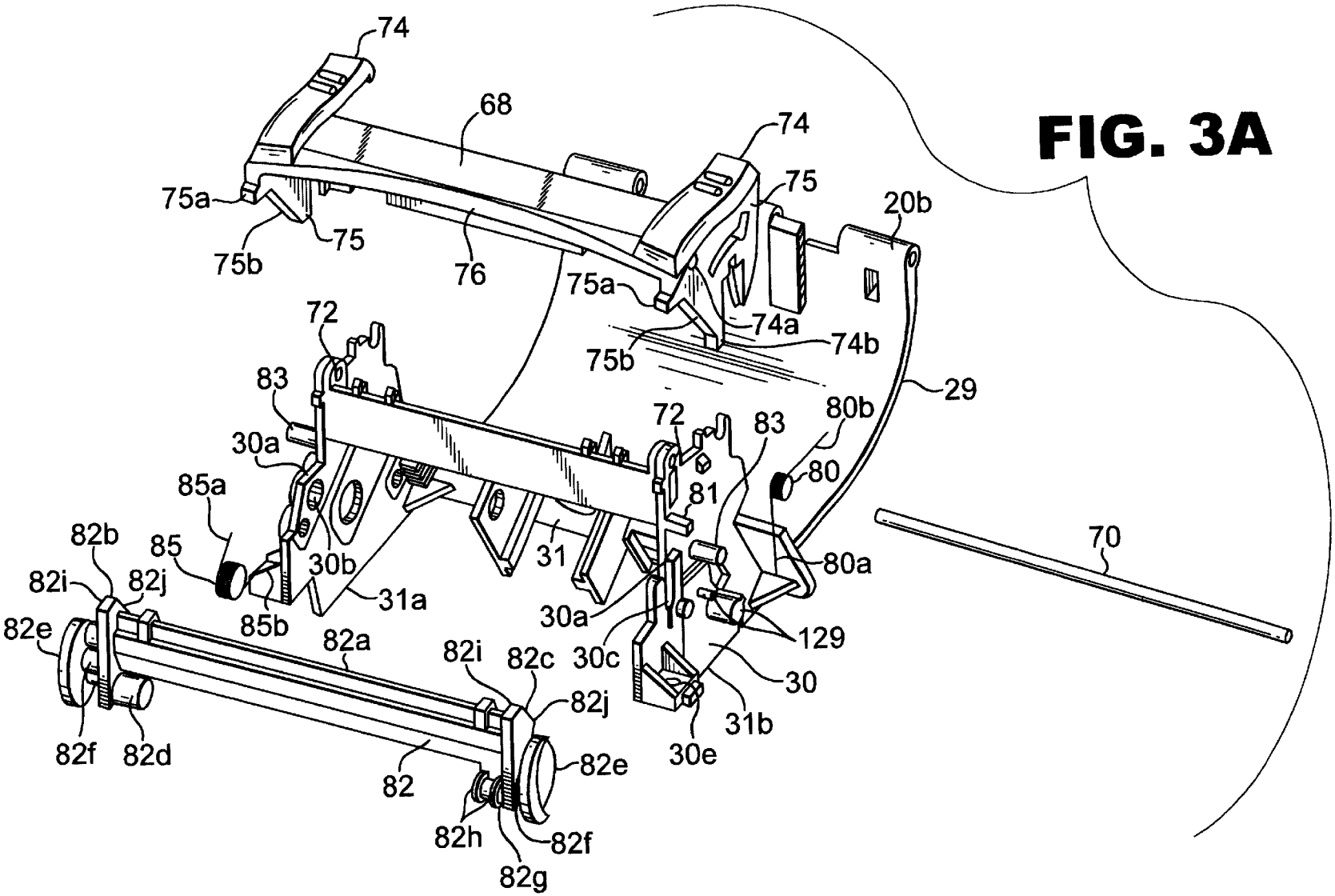
FIG. 3A is a partial exploded view of the portable printer of FIG. 1 showing the latch member and pawl of the locking mechanism with respect to the frame of the printer.
Figure 6:
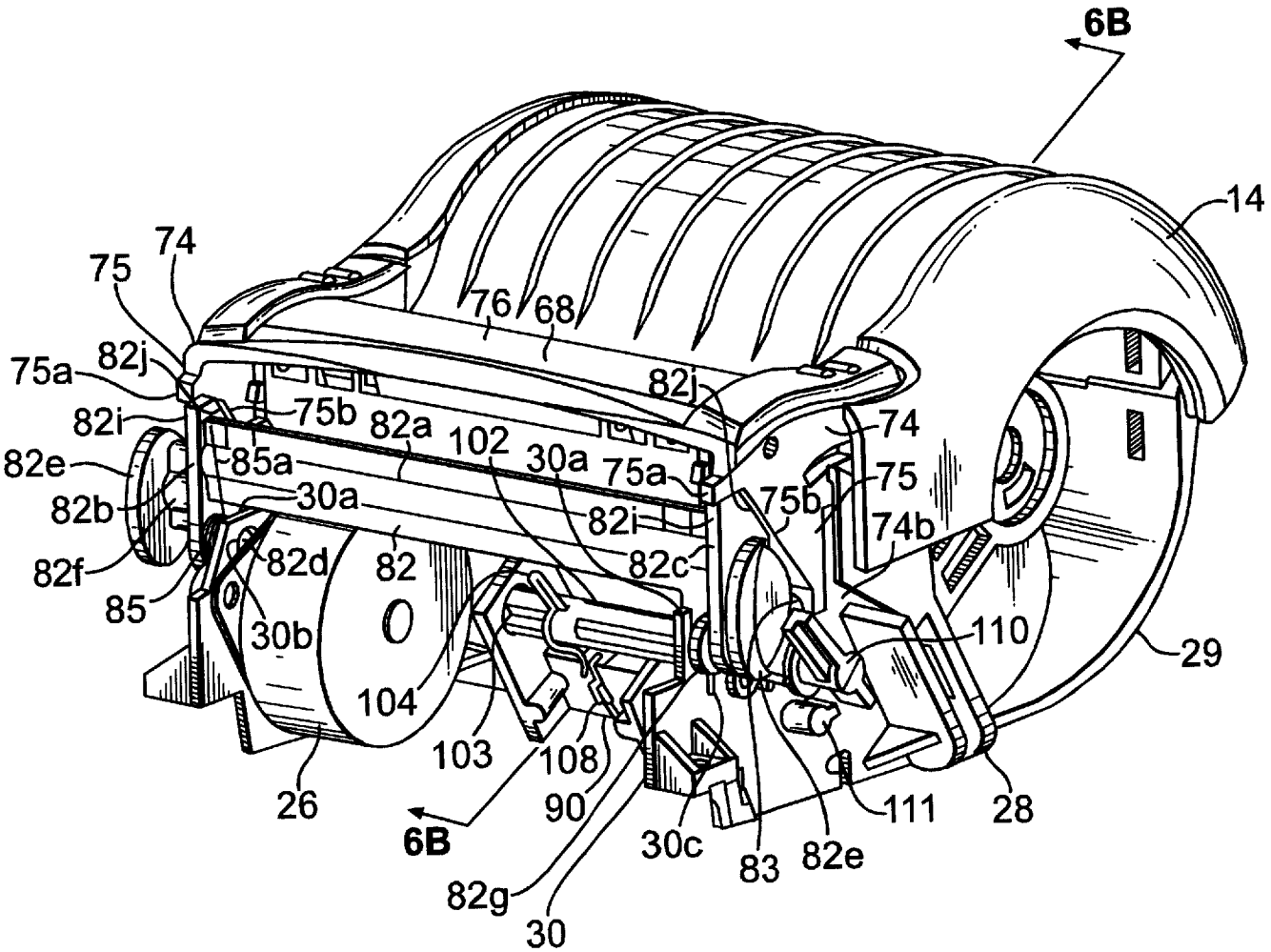
FIG. 6 is a perspective view of the front of the printer of FIG. 1 with the upper and lower housing sections removed to show the locking mechanism for the centering mechanism with the latch member closed upon the cover of the printer.
Figure 6A:
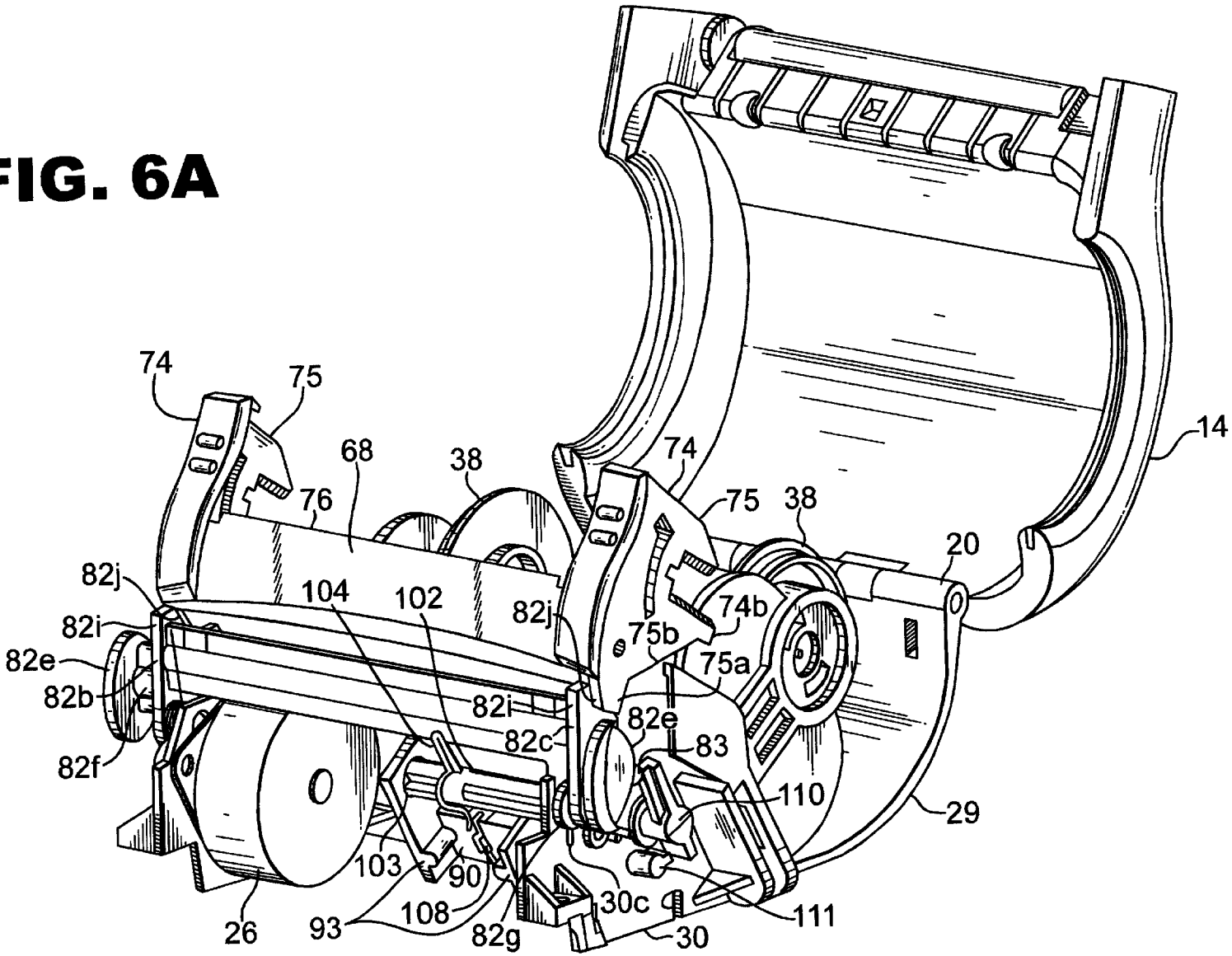
FIG. 6A is another perspective view of the front of the printer similar to FIG. 6 showing the cover of the printer opened.

The housing 12 further has a pivotably mounted latch member 68 for latching the cover 14 closed, as shown in FIGS. 1 and 6, and releasing the cover 14 such that the cover may be opened, as shown in FIGS. 2A and 6A. Latch member 68 has two arms 74 coupled by a lateral support member 76. The arms 74 each have downwardly extending leg 75. A shaft 70 extends through a hole 74*a* in each leg 75 and through holes 72 in the left and right walls 31*a* and 31*b* of frame 30. The latch member 68 can pivot on shaft 70 as described below. FIG. 3A shows an exploded view of the latch member 68, frame 30 and shaft 70, while FIG. 3 illustrates the location of shaft 70 in frame 30. Arms 74 are coupled to lateral support member 76 such that they can pivot together downward and locate their legs 75 into respective slots 78 (FIG. 3) on the sides of plate 28 along the outside of walls 31*a* and 31*b* of frame 30 when the frame is assembled to plate 28. The arms 74 pivot downward against the bias of a spring 80 about shaft 70 having one end 80*a* against tab 81 extending from frame 30 and the other end 80*b* against the interior surface of one of the arms 74 above wall 31*b* of frame 30.

The latch member 68 when in a down position is positionally locked by a pawl 82. The pawl 82 is best shown in FIGS. 3, 3A, 6, and 6A, where in FIG. 3 the pawl is indicated by dashed lines, and in FIG. 3 the pawl is shown apart from frame 30. Pawl 82 has a longitudinal member 82*a* and side members 82*b* and 82*c* at its ends. The side members 82*b* and 82*c* are each located along a ledge 30*a* on the left and right walls 31*a* and 31*b*, respectively, of frame 30. Side member 82*b* extends downward outside the left wall 31*a* of the frame and provides shaft 82*d* received in hole 30*b* below ledge 30*a* in the left wall, while side member 82*c* extends downward outside the right wall 31*b* of the frame to form a shaft 82*g* received in a slot 30*c* of the frame below ledge 30*a* in the right wall. Each side member 82*b* and 82*c* extends outwardly to a button 82*e* by a spacer member 82*f*. Each button 82*e* is each received in a recess 82 in the sides of the housing 12 through a slot in housing 12. Such slot on each side of housing 12 may be provided in the upper housing section 12*a* so that latch member 68 may be located to place buttons 82*e* in recesses 82 prior to locating the upper housing section onto lower housing section 12*b*.

The legs 75 extending from arms 74 of latch member 68 each have a projecting section 75*a* which can be captured by the top edge 82*i* of each side member 82*b* and 82*c* of the pawl as the latch member 68 pivots to its down position, while the front edge 82*j* of each side member 82*b* and 82*c* aligns with the back edge 75*b* of each respective leg 75 of the latch member 68. A spring 85 is located around the shaft 82*d* extending from side member 82*b* to hole 30*b* having one end 85*a* against the longitudinal member 82*a* and the other end 85*b* along a boss 84 (FIG. 3) on the left wall of frame 30. Spring 85 applies a forward force on pawl 82 to urge its side members 82*d* and 82*g* into locking engagement with the latch member's legs 75 when the latch member is in its down position. The pawl 82 is pivotable about its shafts 82*d* and 82*g* in hole 30*b* and slot 30*c*, respectively, sufficient to enable this forward lock position with the latch member 68 and allow the operator to push back on the pawl to release the pawl from engagement with the latch member. Thus, to lock latch member 68, an operator of the printer presses downward on the latch member pushing the pawl 82 backwards against the bias of spring 85 until the top edge 82*i* of each side member 82*b* and 82*c* captures their respective projecting section 75*a* of the latch member's leg 75, as shown in FIG. 6. When in the down position, the edge 75*c* of each leg 75 of the latch member 68 abuts the surface 14*g* of each side of the closed cover 14, thereby retaining the cover 14 closed. The downward extent of latch member 86 may be limited by a stop or pin 83 (FIG. 3A) from each left and right wall 31*a* and 31*b* of frame 30 by abutting the end 74*b* of each leg 75 of latch member 68. To unlock latch member 68, the operator pushes the buttons 82*e* of the pawl 82 backwards to move the pawl 82 until the top edge 82*i* releases the latch member's leg 75, and the latch member flips (pivots) up due to force by spring 80 (FIG. 3), as shown in FIG. 6A. This allows the operator access to roll compartment 16 by lifting cover 14, such as to locate a new roll on spindle members 38. When the buttons 82*e* are then released by the operator, the pawl 82 moves to reset to its forward position due to the bias of spring 85. Each of the buttons 82*e* may have a raised area to assist the operator in locating their fingers to push the buttons backwards. The latch member 68 is shown in a down position in FIGS. 1, 2 and 6 and in an up position in FIG. 6A. The latch member 68 may be in an up or a down position when cover 14 is open, such as shown in FIG. 2, where the latch member is shown in its down position. The top surface 74*b* of the arms 74 and of the support member 76 may be contoured to match the contour of the housing 12 when cover 14 is closed.

A locking mechanism is provided to lock the centering mechanism 36 from substantial movement when the cover 14 is latched closed by the latch member 68. The locking mechanism includes a rack lock 86 which represents a cylinder 88 having and open end 86*a* and a closed end 86*b* with one or more projections 87 (shown in dashed line in FIG. 3) attached to a plate 90. The plate 90 has two side notches 92 enabling the rack lock 86 to slide along two track 93 extending on a downward angle from frame 30, such that the open end 86*a* of the cylinder 86 and projections 87 can engage teeth 54 of gear 42 having its cylinder 42*b* extend through opening 94 (FIG. 5), such that the rack lock 86 needs only slight forward movement to engage teeth 54. Projections 87 represent teeth having the same profile of teeth 54 to enable such engagement. A compression spring 96 biases the rack lock 86 away from the gear 42 in which one end 96*a* of the spring is located around cylinder 88 against plate 90, and a second end 96*b* of the spring is located on a ledge 98 of surface 42*c* outside cylinder 42*b* of gear 42. The locking mechanism further has a rack lock actuator 100 having a shaft 102 with two ends 102 extending through openings 103 in right wall 31*b* of frame 30 and left frame track extension providing track 93, and a cotter pin 104 which extend through a slot 106 of the shaft 102 and into a slot 108 of plate 90 of rack lock 86, as shown in FIGS. 6 and 6A. The locking mechanism has a lever 110 coupled at one end of shaft 102 which is pushed downward by the lower end 74*b* of one of the arms 74 of the latch member 68 when moved to a closed position, rotating the shaft 102 of the actuator 100 which turns and pushes forward the cotter pin 104 and the rack lock 86 (against the bias of spring 96) until the projections 87 of the rack lock meet teeth 54 of the gear 42, and thereby locking the position of the gear 42, and coupled racks 40*a* and 40*b* and spindle members 38. This is achieved by tracks 93 preventing rotation of rack lock 86, thereby preventing rotation of the gear 42 meshed (or engaging) the rack lock. When the latch member 68 pivots to an open position, lever 110 is released and the shaft 102 of the actuator 100 rotates forward, turning the cotter pin 104, and allowing the spring 96 to push back the rack lock 86, removing the projections 87 from teeth 54 of the gear, thereby unlocking the centering mechanism. The backward extent of movement of the rack lock 86 is limited by a stop 111 (FIG. 6) abutting the lever 110 at its lower end which limits the rotation of actuator 100. Thus, when the cover 14 is closed and the latch member 68 is locked, the centering mechanism is locked preventing a roll between spindle members 38 from dislodging if the printer is dropped or otherwise impacted.

The assembled plate 28, with racks 40*a* and 40*b*, gear,42, printing mechanism 32, rack lock 86, rack actuator 100, pawl 82, latch member 68, and sensor 130, once assembled to frame 30 are attached to the bottom of lower housing section 12*b* by screws through threaded holes 30*e* in the housing 12, and then the upper housing section 12*a* covers and attaches to the lower housing section. The plate 28, frame 30, pawl 82, and latch member 68 may be made of molded plastic, as well as the racks, gear, spindle members, edge guide arms of the centering mechanism, and the rack lock, and rack lock actuator of the locking mechanism, may be made of molded plastic to enable engagement of respective components as described above.

Figure 7:
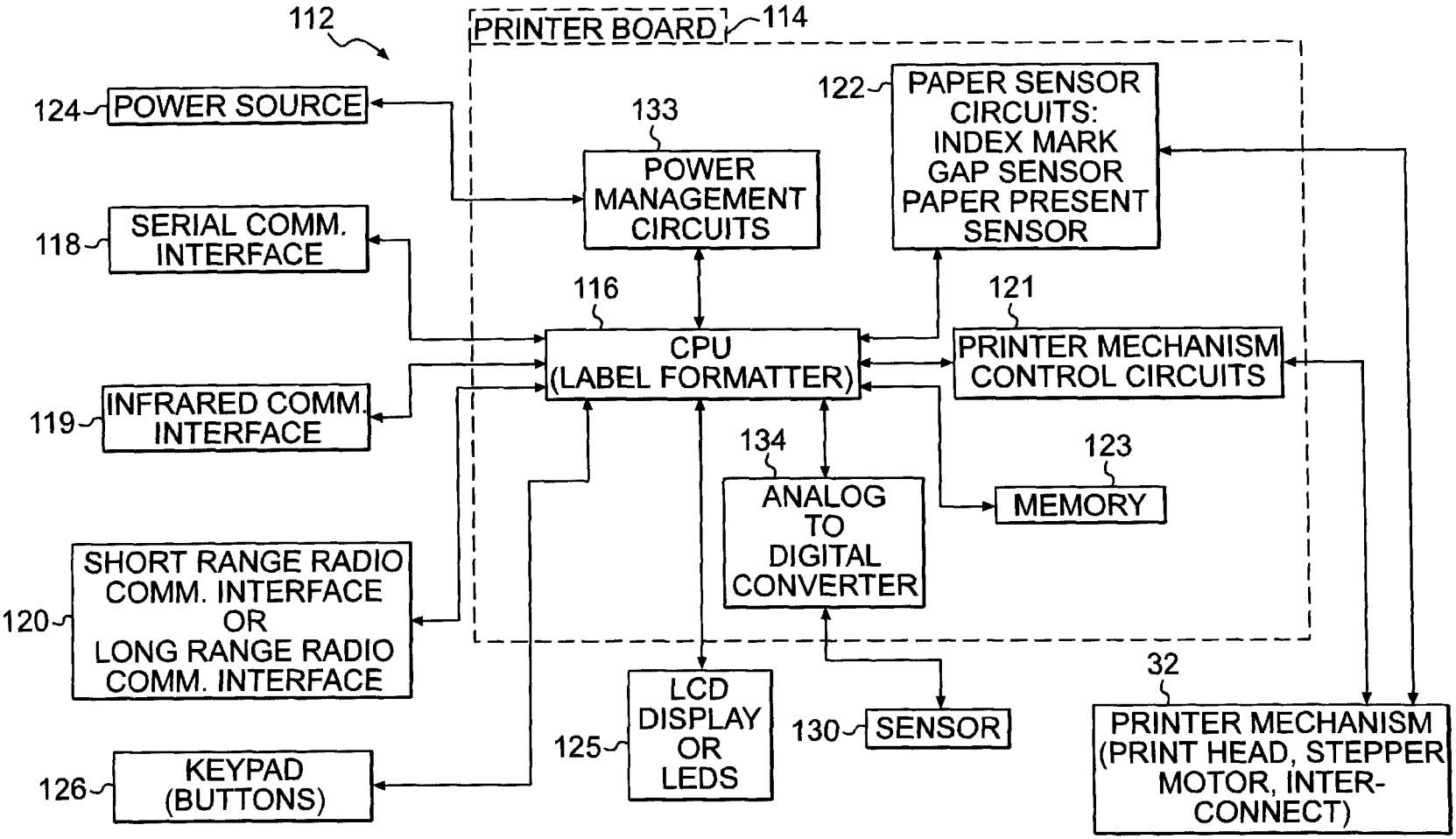
FIG. 7 is a block diagram of the control electronics of the portable printer of FIG. I.

Referring to FIG. 7, a block diagram of the control circuitry is shown. The control electronics 112 may be located on a printed circuit board 114 in housing 12. The control electronics may be the same as described in U.S. Pat. Nos. 5,267,800 or 5,806,993, which is herein incorporated by reference, accordingly the control electronics will only briefly be described. A controller 116, such may be a CPU or microprocessor, is provided which can communicate with a host terminal or computer system via one of different communication interfaces, serial communication interface 118, infrared communication interface 119, or short or long range radio (RF) communication interface 120, to receive commands and data for printing. One or more of these interfaces 118–120 may be provided. The controller 116 controls the print mechanism 32 via control circuit 21 to output lines of data via the print head 33 onto paper from the roll, and the stepper motor 26 to drive the paper across the print head to enable advancement of paper. The printer mechanism 32 is shown as including motor 26 for purposes of illustration. The controller 116 receives signals from paper sense circuits 122 for sensors to detect ink marks, gaps, and presence of papers. For example, an optical sensor 128 may be provided to sense barcodes which may be present on the backside of the paper from the roll or to detect the absence of paper. The controller 116 operates in accordance with a program stored in memory 123. A power source 124, such as a battery, is provided to the components of the control electronics. Power management circuits 133 may be used to control the power to the printer, such as to enable low power standby, as typical of portable printers. The operator interfaces with the controller via LCD display and/or LEDs 125, and a keypad or buttons 126, or a scanner via serial port or wireless connection. A micro-sensor or switch (not shown) may be provided along the outside of wall 131*b* of the frame upon pins 129, which detect when the pawl 82 is pushed backwards in response to the latch member 68 being in a down position by a part of the pawl abutting the actuating element of the switch. Thus, the controller 116 may by reading the state of the switch can determine when the latch member is open or closed generally indicating the opening of the cover 14 to access the roll compartment 16.

Figure 4A:
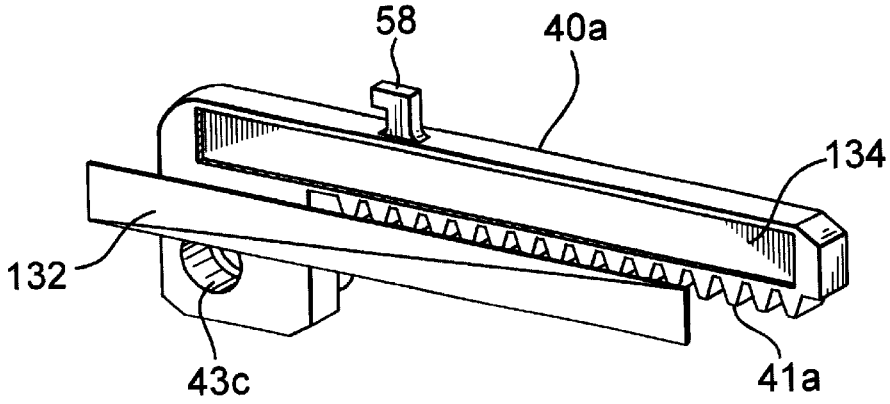
FIG. 4A illustrates the placement of the indicia label to the edge guide rack of the centering mechanism.
Figure 5:
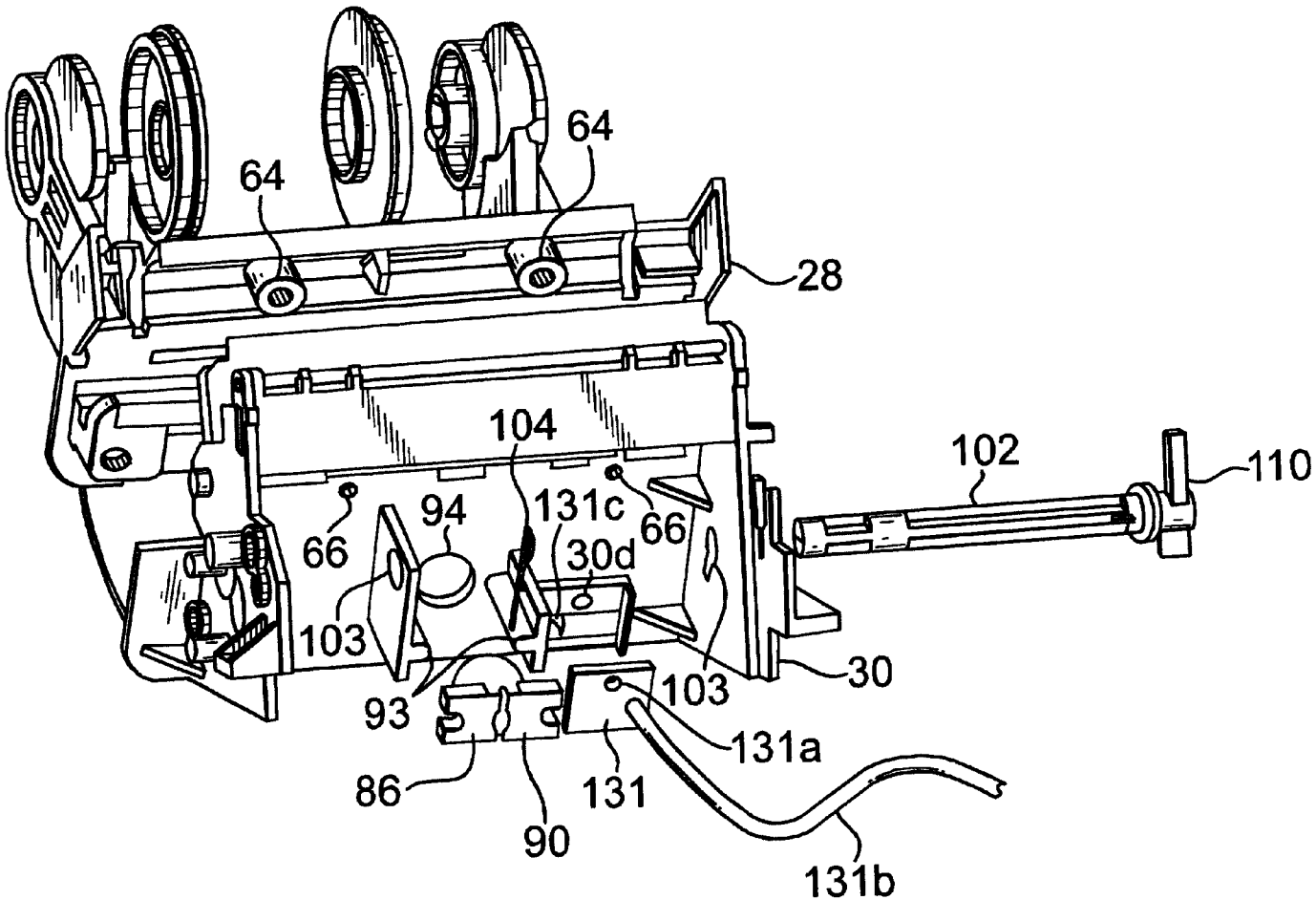
FIG. 5 is an exploded view illustrating the assembly of the locking mechanism for the centering mechanism and the sensor used in detecting roll widths.

Referring to FIGS. 3 and 5, a sensor 130 is mounted on a board 131 to frame 30 via a screw through threaded frame hole 30*d* and hole 131*a* on the board. The sensor reads indicia 132 located on rack 40*a* which encodes the position of the centering mechanism 36 representative of width of the centered roll. The sensor 130 views a portion of indicia 132 through an opening 131*c* in the frame 30. The indicia 128 may represent a label applied in a recess 134 to the rack 40*a*, such as by an adhesive, as best shown in FIG. 4A. The indicia encodes positional information of the centering mechanism as an intensity gradient (amount of black) which increases or decreases along the length of the rack 40*a*. For example, the sensor may be an IR (Infrared) emitter detector pair sensor, such as sensor model no. GP2S40 manufactured by the Sharp Corporation, however separate illumination source and detection sensor may be used. Cable 131*b* connects the sensor to the printed circuit board 114 in housing 12. The indicia 132 is sensitive to the wavelength(s) of operation of the sensor, such as to return reflected light representative of the indicia. The distance between the position of indicia 132 and the viewing sensor 130 may be less than ⅛ inch when frame 30 is assembled to plate 28. For example, the label may be provided by ink of a high carbon content, or other ink suitable for returning light to the sensor may be used. The portion of the indicia read by the sensor provides an intensity value representative of the position of the centering mechanism, and depends on the location of the racks and their coupled spindle members 38 engaging roll 15. This intensity value is an analog signal converted by an analog to digital (A/D) converter 134 into a digital data value representing the detected width. The controller 116 associates detected width with a roll width using a look-up-table stored in memory 132. The look-up-table may be generated by calibrating the data from the sensor, via the A/D converter, with reference rolls of known width centered on the spindle members 38. For example, three roll references, such as metal tubes, may be provided representing the smallest, middle, and largest roll widths for the printer. Each roll reference is located between the spindle member 38, and the data value for that width detected by the controller 116 from the sensor 130, via the A/D converter 134, for association with the reference roll's width in. the look-up-table. Detected widths for rolls of intermediate widths between the reference roll widths may be extrapolated based on a linear slope as the intensity gradient of the indicia is substantially linear. However, other encoding gradients may be used of the indicia, which need not be linear. Although the indicia 132 is shown as having two white triangular section for purposes of illustration, one of these triangular sections is actually black to achieve a gradient. Memory 132 may include an EPROM which is loaded with this look-uptable.

In operation, the controller 116 reads the data value from the sensor 130, via the A/D converter 134, locates the roll width for that data value in memory, and automatically aligns the output line of information to be printed by the print head 33 with the roll's width by selection of printing elements. In this manner, printing element within the centered width of the paper are used, and printing elements outside the width of the paper are not used. If the line of information to be printed is outside the roll width, the user and/or host may be informed of the problem prior to printing of on the paper, and the print information may be rescaled or clipped to within the detected width. This permits the portable printer to energize printing elements that fall within the detected width of the paper, and to not energize printing elements outside the detected width of the paper, thereby preventing damage to the print head. For example, the number of pixels of the line of the information (e.g., image, graphics, barcodes, or text) to be printed may be compared to the size of a line of pixels in accordance (or in proportion to) the detected width of the paper which may be provided in the look-up-table in memory. When the number of pixels of the line to be printed is greater than the size of line of pixels in accordance with the detected width, the printing elements in accordance with pixels within the centered width of the paper are selected for enablement during printing, and those printing elements associated with pixels outside the centered width of the paper are not used or disabled. This may be achieved by reformatting, or clipping at one or both ends, the line of pixels of the information to select the pixels to be printed by printing elements, such that printing elements in accordance with pixels falling outside the centered width of the paper are not energized when the line of pixels is printed. The width of the roll may be checked by the controller 116 before each label is printed, periodically (e.g., every 5 seconds), upon powering on the printer, or after the controller 116 senses a change in state of one of its sensors, such as the micro switch detecting the latch member being closed or sensing the absence of paper. Thus, automatic alignment of printing to the roll width is achieved.

Figure 8:
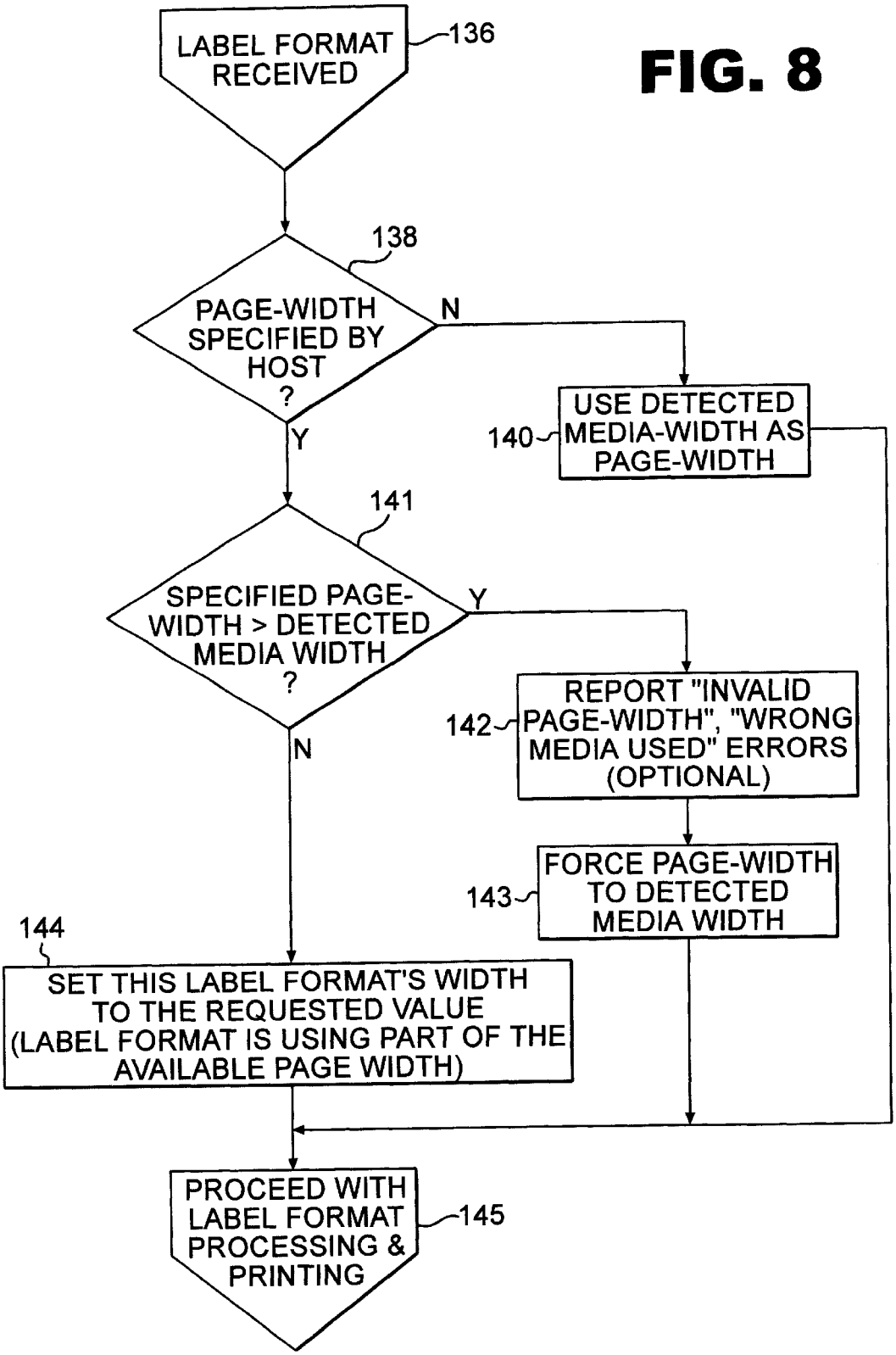
FIG. 8 is a flow chart showing the operation of the portable printer of FIG. 1 for formatting a label.

Referring to FIG. 8, a flow chart is provided showing an example of the operation of the controller 116 to format a label to be printed. In this example, the term page-width represents the width of the information to be printed, and media-width as the detected width of the paper. Width may be in terms of actual dimension of the roll, or a value or code representative of width (or of pixel line width). First the host sends a command and data to be printed (step 136). The command may or may not include a page-width. If a page-width is not specified by the host (step 138), the detected media with is used as the page-width (step 140), and the label is formed and printed (step 145). The controller 116 may maintain the last detected media-width in memory 132. If the page width is specified in the command at step 138 and the page width is greater than the detected media-width (step 141), an optional "invalid page-width" or "wrong media used" error message is reported to the user via the LCD display and/or the host (step 142), and the page-width is set (forced) to the detected width (step 143), and the label is formatted and printed (step 145). If at step 141, the specified page-width is not greater that the detected width, the label format's width is set to the request value (step 144), and the label is formatted and printed (step 145). In other word, the label format uses the entire or part of the available page width of the paper from the roll. An advantage of using width detection is that it permits the printer to format text, barcode, and graphics as appropriate for the width of the paper from the roll. For example, the same host commands for formatting text can be used to print on two-inch wide paper as well as three inch-wide paper. The controller by automatic alignment of printing through paper width detection, will format the text for the actual width of the paper.

In the alternative to an optical sensor and indicia to encode the position of the centering mechanism, a magnetic sensor and magnet on one of the rack or edge guide arm may be used to magnetically encode the position of the centering mechanism with respect to roll width. The magnetic sensor may be a Hall Effect magnetic sensor, and the indicia replaced by a magnet or magnetic strip capable of being read by the sensor. As the distance (and/or position) between the magnetic sensor and the magnet changes with the position of the centering mechanism, the level of the magnetic field strength and/or polarity detected by the sensor varies, and the sensor outputs a voltage signal which varies in proportion to the detected level and/or polarity. The controller 116 receives the output of the sensor, via the A/D converter 134, to obtain the encoded position of the centering mechanism. Similar to optical sensor and indicia, memory 123 stores a look-up-table to associate the output of the sensor for different roll widths. Examples of Hall Effect sensors which may be used include, sensor of model no. Hal805 manufactured by Micronas of Germany, or model no. OHN3150U manufactured by Optek of Worcester, Mass.

In a further alternative to an optical sensor and indicia, an electro-mechanical encoder may be used having a wheel coupled to one of the racks 40*a* or 40*b* or to gear 42, which rotates in response to movement to output a value representative of the absolute or change in position of the centering mechanism and the width of the roll. Such values may received via the A/D converter 134, if necessary, and associated with different roll width in a look-up-table in memory 123. Electro-mechanical encoding of the position of the centering mechanism may also be provided a resistive strip which replaces the indicia on rack 40*a*. The resistive strip is coupled at one end to a positive voltage and at its other end to a negative voltage (or ground), such that a fixed electrical wire or wiper, which represents a sensor, contacts the resistive strip at a location, can read the voltage of the strip. As the rack moves, different locations along the resistive strip will contact the wiper, resulting in different read voltage signals proportional to the location of the rack, thereby encoding the position of the centering mechanism with respect to the roll's width. These voltage signals may be received by controller 116 via the A/D converter 134, and associated with different roll width in a look-up-table in memory 123. Alternatively, the resistive strip may be fixed to frame 30 and the wiper attached to a rack or edge guide arm of the centering mechanism and moveable therewith. For example, the resistive strip may be a mystR strip manufactured by Honeywell Inc. or Morristown, N.J.

Figure 9:
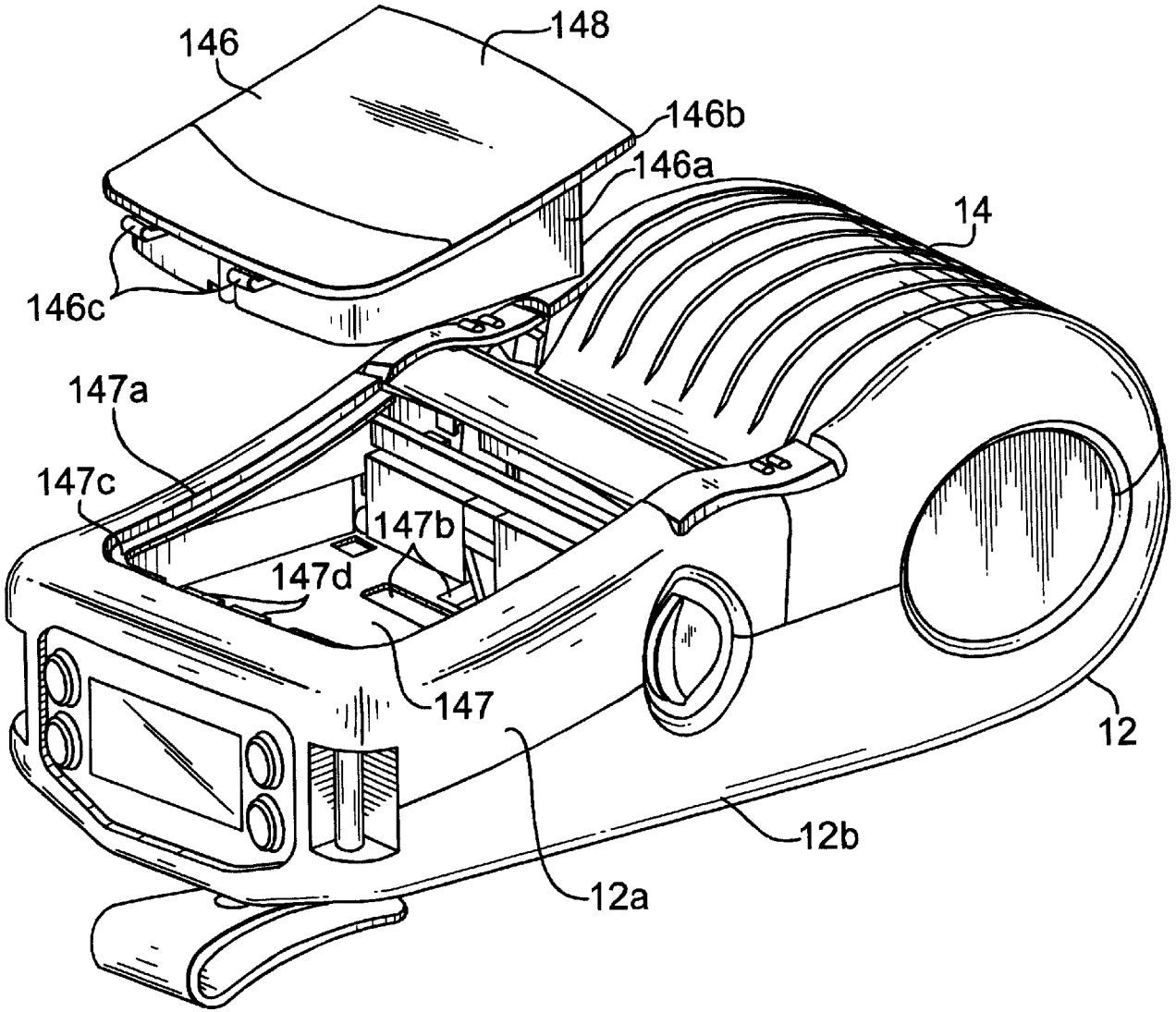
FIG. 9 is the same view as FIG. 1 showing the RF module removed from the housing of the printer.

The short or long range radio communication interface 120 is provided by a removable RF communication module 146 which is shown removed from housing 12 in FIG. 9 and received in housing 12 in FIG. 1. The module is received via in opening 147*a* to a cavity 147 in the upper housing section 12*a*. One or more connectors 147*b*, are provided in cavity 147 which is coupled to a connector (not shown) on the module 146 such as to supply power to the module and send and transmit data to and from controller 116. The module 146 has walls and on outer surface 148 which forms part of housing 12 when module 146 is received in cavity 147. The outer edge of this wall provides a lip 146*b* which is received along a ledge 147*c* of cavity 147. The module 146 is retained in the cavity by one or more tongues or hooks 146*c* which are received in grooves 147*d* spaced along ledge 147*b*. For example, the module 146 may provide communication to a host computer or terminal directly, such as using Bluetooth Communication protocol, or via a 802.11b or 802.11a LAN communication through a server computer system to the host computer or terminal. However, other wireless communication protocols may be used. Optionally, the printer may be provided without module 146 in which a cover having outer surface 148 is provided with lip 146*b* and tongues 146*c* to retain the cover over cavity 147 in housing 12.

The portable printer is a miniature portable printer capable of being hand carried or worn by the user, such as using a belt clip 150 attached to the housing 12 or on a strap (not shown) via hooks 152 on the housing 12, as shown in FIGS. 1 and 2. The housing 12 of the printer is preferably less than 2 pounds in weight (without the RF module), and of a miniature size of about 20 cm long, 12 cm wide and 8 cm high (at the closed cover).

From the foregoing description, it will be apparent that there has been provided an improved portable printer for automatic print alignment. Variations and modifications in the herein described portable printer, and assembly thereof, in accordance with the invention will undoubtedly suggest themselves to those skilled in the art. For example, other roll centering mechanisms having a rack and pinion assembly, or other roll centering assembly, may be used in which the encoded position of one or more movable parts of that assembly may be read by a sensor. Accordingly, the foregoing description should be taken as illustrative and not in a limiting sense.

What is claimed is:

1. A portable printer for printing on a roll of paper or label stock comprising:

a housing having a compartment for receiving the roll;

means for centering the roll between two rotatable spindle members in said compartment engageable with the opposing ends of said roll to enable each of said spindle members to move in opposite directions with respect to a center between the spindle members;

means for encoding the position of said centering means representative of the width of said roll;

means for reading the encoding position of said centering means;

a printing mechanism in said housing with printing elements in which the printing mechanism is capable of printing on the paper or label stock from said roll; and means for automatically controlling the alignment of printing by said printing mechanism with respect to the width of said roll in accordance with the read encoded position.

2. The portable printer according to claim 1 wherein said centering means further comprises a pair of racks and a gear, each said rack being coupled to one of said spindle members and to each other by said gear to enable each of said spindle members to move in opposite directions with respect to the center between the spindle members.

3. The portable printer according to claim 2 wherein said encoding means represents indicia on at least one of said racks encoding the position of the spindle member coupled to said rack, and said reading means comprises a sensor for reading a portion of said indicia representative of the position of the spindle member coupled to the rack having said indicia, and said means for automatically controlling the alignment of printing represents a controller for said printing mechanism which automatically controls the alignment of printing with respect to the width of said roll in accordance with the portion of said indicia read by said sensor.

4. The portable printer according to claim 3 wherein said sensor reads said indicia by detecting light from said indicia, in which said portion of said indicia read by said sensor provides a different intensity of said light to said sensor depending on the position of the spindle member coupled to the rack having said indicia.

5. The portable printer according to claim 4 wherein said controller associates said intensity of said light read by said sensor with the width of the roll.

6. The portable printer according to claim 3 wherein each said spindle member has a hub and a disk member rotationally mounted to said hub for engaging with the opposing ends of the center of said roll to enable rotational movement of said roll in said compartment, and an arm coupling the spindle member to one of the racks.

7. The portable printer according to claim 3 wherein said indicia represents an intensity gradient which differs along the length of said rack.

8. The portable printer according to claim 2 wherein said housing further comprises a cover for accessing said compartment, and said portable printer further comprises:

a pivotable lock actuator which pivots to a first position when said cover is closed and pivots to a second position when said cover is opened; and a gear lock member locatable in a lock position against said gear to lock the rotation of said gear, and in an unlock position to release said gear, in which said lock member is mechanically coupled to said lock actuator to move to said lock position when said lock actuator is in said first position and to move to said unlock position when said lock actuator is in said second position.

9. The portable printer according to claim 8 wherein said gear lock member further comprises a spring which biases said gear lock member away from said gear when said gear lock member is in said unlock position.

10. The portable printer according to claim 8 further comprising means for latching said cover closed and operative to release said cover, and said lock actuator is mechanically coupled to said latching means to pivot to said first position when said cover is being maintained closed by said latching means and to said second position when said cover is released by said latching means.

11. The portable printer according to claim 2 wherein said encoding means is operative by magnetically encoding the position of the centering means with respect to the width of the roll, and said reading means magnetically detects the encoded position.

12. The portable printer according to claim 2 wherein said encoding means represents a rotationally position encoder coupled to one of said racks or gear which encodes the position of the centering means with respect to the rotational movement of the gear, and said reading means is provided by said means for automatically controlling the alignment by reading the value of said encoder representative of the width of the roll.

13. The portable printer according to claim 2 wherein said encoding means represents a resistive strip associated with the centering mechanism having an applied voltage which differs along the length of the strip, and said reading means is provided by said means for automatically controlling the alignment by reading a voltage signal from said resistive strip representative of the width of the roll.

14. The portable printer according to claim 1 wherein said housing further comprises a cover for accessing said compartment.

15. The portable printer according to claim 14 comprising means for locking the position of said centering means when said cover is closed.

16. The portable printer according to claim 1 further comprising a removable RF communication module locatable in said housing for enable communication between said printer and a host terminal or computer.

17. The portable printer according to claim 1 wherein said means for automatically controlling alignment further comprises means for selecting the printing elements of the printing mechanism for printing in accordance with the width of the roll to prevent damage to the print head by use of printing elements outside the width of the roll.

18. A portable printer for printing on a roll of paper or label stock comprising:

a housing having a compartment for receiving the roll and a cover for accessing said compartment;

two rotatable spindle members in said compartment engageable with the opposing ends of said roll;

a pair of racks, each said rack being coupled to one of said spindle members and to each other by a gear to enable each of said spindle members to move in opposite directions with respect to a center between the spindle members, in which one of said racks has indicia encoding the position of the spindle member coupled to said rack; and means for locking the position of said spindle members when said cover is closed.

19. The portable printer according to claim 18 wherein said locking means comprises:

a pivotable lock actuator which pivots to a first position when said cover is closed and pivots to a second position when said cover is opened; and a gear lock member locatable in a lock position against said gear to lock the rotation of said gear, and in an unlock position to release said gear, in which said lock member is mechanically coupled to said lock actuator to move to said lock position when said lock actuator is in said first position and to move to said unlock position when said lock actuator is in said second position.

20. The portable printer according to claim 19 further comprising means for latching said cover closed and operative to release said cover, and said lock actuator is mechanically coupled to said latching means to pivot to said first position when said cover is being maintained closed by said latching means and to said second position when said cover is released by said latching means.

21. A method for automatically aligning the printing in a portable printer to the width of a roll of paper or label stock comprising the steps of:

providing two rotatable spindle members engageable with the opposing ends of said roll, and two racks each one of said racks coupled to one of said spindle members and to each other by a gear to enable each of said spindle members to move in opposite directions with respect to a center between the spindle members;

providing on one of said racks indicia encoding the position of the spindle member coupled to said rack;

reading a portion of said indicia representative of the position of the spindle member coupled to the rack having said indicia; and automatically controlling the alignment of printing by said printer with respect to the width of said roll in accordance with the portion of said indicia read.

22. The method according to claim 21 further comprising the step of providing a cover for accessing said roll in said printer.

23. The method according to claim 22 further comprising the step of locking the position of said spindle members when said cover is closed.

24. A portable printer for printing on a roll of paper or label stock comprising:

a housing having a compartment for receiving the roll;

two rotatable spindle members in said compartment engageable with the opposing ends of said roll;

a pair of racks, each said rack being coupled to one of said spindle members and to each other by a gear to enable each of said spindle members to move in opposite directions with respect to a center between the spindle members, in which one of said racks has indicia encoding the position of the spindle member coupled to said rack;

a fixed sensor for reading a portion of said indicia representative of the position of the spindle member coupled to the rack having said indicia;

a printing mechanism in said housing with printing elements in which the printing mechanism is capable of printing on the paper or label stock from said roll; and a controller for automatically controlling the alignment of printing by said printing mechanism with respect to the width of said roll in accordance with the portion of said indicia read by said sensor.

25. A portable printer for printing on a roll of paper or label stock comprising:

a housing having a compartment for receiving the roll;

means for centering the roll in said compartment;

means for encoding the position of said centering means representative of the width of said roll;

means for reading the encoding position of said centering means;

a printing mechanism in said housing with printing elements in which the printing mechanism is capable of printing on the paper or label stock from said roll; and means for automatically controlling the alignment of printing by said printing mechanism with respect to the width of said roll in accordance with the read encoded position to prevent use of printing elements outside the width of the roll.

26. A method for automatically aligning the printing in a portable printer to the width of a roll of paper or label stock comprising the steps of:

providing a housing having a compartment for receiving the roll;

centering the roll in said compartment;

encoding the position of said centering means representative of the width of said roll;

reading the encoding position of said centering means; and aligning of printing with respect to the width of said roll in accordance with the read encoded position to prevent printing outside the width of the roll.

* * * * *